US007399111B2

(12) United States Patent
MacDonald et al.

(10) Patent No.: US 7,399,111 B2
(45) Date of Patent: Jul. 15, 2008

(54) APPARATUS AND METHOD FOR MIXING FLUID DISPERSIONS DISPOSED IN CONTAINERS OF DIFFERENT SIZES AND CONSTRUCTION

(75) Inventors: James E. MacDonald, Medina, OH (US); Dwight R. Huckby, Brookpark, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 7 days.

(21) Appl. No.: 10/435,736

(22) Filed: May 9, 2003

(65) Prior Publication Data

US 2004/0008573 A1 Jan. 15, 2004

Related U.S. Application Data

(60) Provisional application No. 60/379,889, filed on May 10, 2002.

(51) Int. Cl.
*B01F 11/00* (2006.01)

(52) U.S. Cl. ..... 366/110; 366/111; 366/209; 366/605

(58) Field of Classification Search ..... 366/110, 366/111, 209, 211, 212, 605
See application file for complete search history.

(56) References Cited

U.S. PATENT DOCUMENTS

| | | | |
|---|---|---|---|
| 1,301,536 A | 4/1919 | Bee | |
| 2,006,451 A | 7/1935 | Glidden | |
| 3,301,534 A | 1/1967 | Orser | |
| 3,503,592 A | 3/1970 | Taylor, Sr. et al. | |
| D217,231 S | 4/1970 | Pashman | D9/239 |
| 3,542,344 A | 11/1970 | Oberhauser | |

(Continued)

FOREIGN PATENT DOCUMENTS

| | | | |
|---|---|---|---|
| DE | 94 00 396.3 | | 4/1994 |
| FR | 2 537 453 | A1 | 6/1984 |
| GB | 1 310 655 | * | 3/1973 |

OTHER PUBLICATIONS

Database WPI, Section CH, Week 198350, Derwent Publications Ltd., London, GB; AN 1983-843553, XP002228265 & SU 997 778 A (Gonchar V P), Feb. 23, 1983 abstract.

Patent Abstracts of Japan, vol. 010, No. 366 (C-390), Dec. 6, 1986 & JP 61 161128 A (Internatl Paint KK), Jul. 21, 1986 abstract.

*Primary Examiner*—David L Sorkin
(74) *Attorney, Agent, or Firm*—Arthi K. Tirey; Robert E. McDonald; Paul R. Katterle

(57) ABSTRACT

Apparatus and method for mixing a fluid dispersion disposed in a container. The apparatus includes a table upon which the container may be disposed. A clamp assembly is disposed above the table so as to define a holding space therebetween. The clamp assembly is movable between an uppermost position and a lowermost position, wherein when the clamp assembly is in the uppermost position, the holding space has a maximum height and when the clamp assembly is in the lowermost position, the holding space has a minimum height. At least one blocking structure is disposed between the table and the clamp assembly to limit the downward movement of the clamp assembly and thereby establish the lowermost position of the clamp assembly, wherein the blocking structure is positioned to provide that the minimum height of the holding space is at least 30% of the maximum height of the holding space.

5 Claims, 10 Drawing Sheets

U.S. PATENT DOCUMENTS

| | | | | | |
|---|---|---|---|---|---|
| 3,885,357 | A | | 5/1975 | Hoyt | 51/163 |
| 4,004,783 | A | | 1/1977 | Wilson | |
| 4,134,689 | A | | 1/1979 | Ahrenskou-Sorensen | 366/110 |
| 4,183,677 | A | | 1/1980 | de Bruyne | 366/209 |
| 4,227,625 | A | * | 10/1980 | Underwood | 220/789 |
| 4,235,553 | A | | 11/1980 | Gall | 366/208 |
| 4,265,548 | A | | 5/1981 | Hall | 366/208 |
| 4,329,068 | A | | 5/1982 | Neuner et al. | 366/214 |
| 4,491,307 | A | | 1/1985 | Ellefson | 269/55 |
| 4,497,581 | A | | 2/1985 | Miller | 366/208 |
| D279,763 | S | | 7/1985 | Hestehave et al. | D9/375 |
| 4,530,442 | A | * | 7/1985 | Vogel et al. | 220/798 |
| 4,842,415 | A | * | 6/1989 | Cane et al. | 366/110 |
| 5,066,136 | A | * | 11/1991 | Johnson | 366/209 |
| D323,115 | S | | 1/1992 | Kelsey | D9/423 |
| 5,167,448 | A | | 12/1992 | Herold et al. | 366/213 |
| 5,197,802 | A | | 3/1993 | Miller et al. | 366/217 |
| 5,268,620 | A | | 12/1993 | Hellenberg | 318/114 |
| 5,269,438 | A | | 12/1993 | Kelsey | 220/766 |
| 5,437,505 | A | | 8/1995 | Sanders et al. | 366/209 |
| D362,180 | S | | 9/1995 | Haines | D9/424 |
| 5,462,353 | A | * | 10/1995 | Gatlin | 366/209 |
| D372,197 | S | | 7/1996 | Gough | D9/532 |
| 5,551,779 | A | | 9/1996 | Gantner et al. | 366/217 |
| 5,711,601 | A | | 1/1998 | Thomas et al. | 366/209 |
| 5,788,371 | A | | 8/1998 | Neri et al. | 366/217 |
| 5,855,304 | A | | 1/1999 | Dean et al. | 222/481 |
| 5,906,433 | A | * | 5/1999 | Mazzalveri | 366/209 |
| 5,906,434 | A | | 5/1999 | Berrios | 366/213 |
| 6,530,500 | B2 | | 3/2003 | Bravo et al. | 222/143 |
| 2002/0195471 | A1 | | 12/2002 | Nottingham et al. | 222/570 |
| 2004/0013031 | A1 | * | 1/2004 | Salas et al. | 366/141 |

* cited by examiner

APPARATUS AND METHOD FOR MIXING FLUID DISPERSIONS DISPOSED IN CONTAINERS OF DIFFERENT SIZES AND CONSTRUCTION

CROSS-REFERENCE TO RELATED APPLICATION

This application claims the benefit of U.S. provisional patent application No. 60/379,889 filed on May 10, 2002, the entirety of which is hereby incorporated by reference.

BACKGROUND OF THE INVENTION

The present invention relates to the mixing of fluid dispersions and more specifically to apparatus and methods for mixing paint disposed in a container.

As is well known, solids in fluid dispersions, such as paint, tend to settle in a downward direction through the force of gravity. Fluid dispersions disposed in containers for commercial sale are typically mixed in the containers before they are used by the purchasers. Many fluid dispersions can be facilely mixed in a container by manually shaking the container. Other fluid dispersions, however, such as paint, are more difficult to manually mix in a container and, thus, are often mixed in the container using a machine that shakes, rotates, vibrates or otherwise moves the container.

A variety of different types of mixing machines are known for mixing fluid dispersions disposed in containers. One type of known mixing machine is disclosed in U.S. Pat. No. 4,134,689 to Ahrenskou-Sorensen, which is hereby incorporated by reference. This type of mixing machine comprises a table having a support surface upon which a container may be placed. A clamping member is movably mounted above the table for clamping the container to the table. A first electric motor is operable to vertically move the clamping member toward and away from the table. The amount of pressure applied by the clamping member to the container is monitored by measuring the current drawn by the first electric motor. When the current drawn by the first electric motor exceeds a certain upper level corresponding to a maximum amount of force, electric power to the first electric motor is either cut off or limited to the upper current level. In this manner, the force applied to the container does not exceed the maximum amount.

When the container is firmly clamped to the table, a second electric motor is operable to vibrate the table and the clamping member to mix the fluid dispersion in the container.

The foregoing type of mixing machine can hold different sized containers, such as a 5 gallon paint container or a 1 gallon paint container. In addition, the mixing machine can hold a plurality of 1 gallon containers, such as a case of 1 gallon containers. Regardless of the type of container or number of containers placed on the table, the clamping member applies the same maximum amount of force to the container(s). Typically, the maximum amount of force is based on the amount of force required to securely hold a 5 gallon container of paint during shaking, which is usually around 900 ft-lbs or more of force. Unfortunately, this amount of force can crush a smaller container that is not as structually strong as a 5 gallon container. For example, the mixing machine will often crush a single 1 gallon container of conventional steel construction if the container has been dented or otherwise damaged. Moreover, the mixing machine would crush a container having an unconventional plastic construction, such as is disclosed in U.S. patent application Publication No. US2001/0025865A1 to Bravo et al., which is hereby incorporated by reference.

U.S. Pat. No. 5,268,620 to Hellenberg discloses an improved mixing machine that addresses the foregoing deficiency of the mixing machine of U.S. Pat. No. 4,134,689. This improved mixing machine has an opto-coupler or shaft encoder for determining the absolute vertical position of the clamping member. The opto-coupler or shaft encoder is connected to a sophisticated control system, which utilizes the position of the clamping member to change the maximum amount of force to be applied by the clamping member. The control system stores a first maximum force, such as for a 5 gallon container and a second maximum force, such as for a 1 gallon container, which is less than the first maximum force. Initially, the control system will limit the force applied by the clamping member to the first maximum amount of force. If, however, the clamping member travels below the height of a standard 5 gallon container without experiencing resistance, the control system determines that a 1 gallon container or other type of small container is present in the mixing machine. In response, the control system will limit the force applied by the clamping member to the second maximum amount of force.

Although the mixing machine of U.S. Pat. No. 5,268,620 solves the force problem for a conventional 1 gallon steel container, it does not solve the force problem for a container having an unconventional plastic construction, such as is disclosed in U.S. patent application Publication No. US2001/0025865A1 to Bravo et al.

Accordingly, there is a need in the art for an improved apparatus and method for mixing fluid dispersions disposed in containers having different sizes and constructions. The present invention is directed to such an apparatus and method.

SUMMARY OF THE INVENTION

It therefore would be desirable, and is an advantage of the present invention, to provide an apparatus for mixing a fluid dispersion disposed in a container. The apparatus includes a table upon which the container may be disposed. A clamp assembly is disposed above the table so as to define a holding space therebetween. The clamp assembly is movable between an uppermost position and a lowermost position, wherein when the clamp assembly is in the uppermost position, the holding space has a maximum height and when the clamp assembly is in the lowermost position, the holding space has a minimum height. A first electric motor is connected to the clamp assembly for moving the clamp assembly toward and away from the table so as to change the height of the holding space. A second electric motor is connected to the table for vibrating the table, thereby mixing the fluid dispersion in the container. A control system is electrically connected to the first electric motor and operable to control the first electric motor so as to move the clamp assembly downward into clamping engagement with the container and maintain a clamping pressure that does not exceed a predetermined maximum amount. At least one blocking structure is disposed between the table and the clamp assembly to limit the downward movement of the clamp assembly and thereby establish the lowermost position of the clamp assembly, wherein the blocking structure is positioned to provide that the minimum height of the holding space is at least 30% of the maximum height of the holding space.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
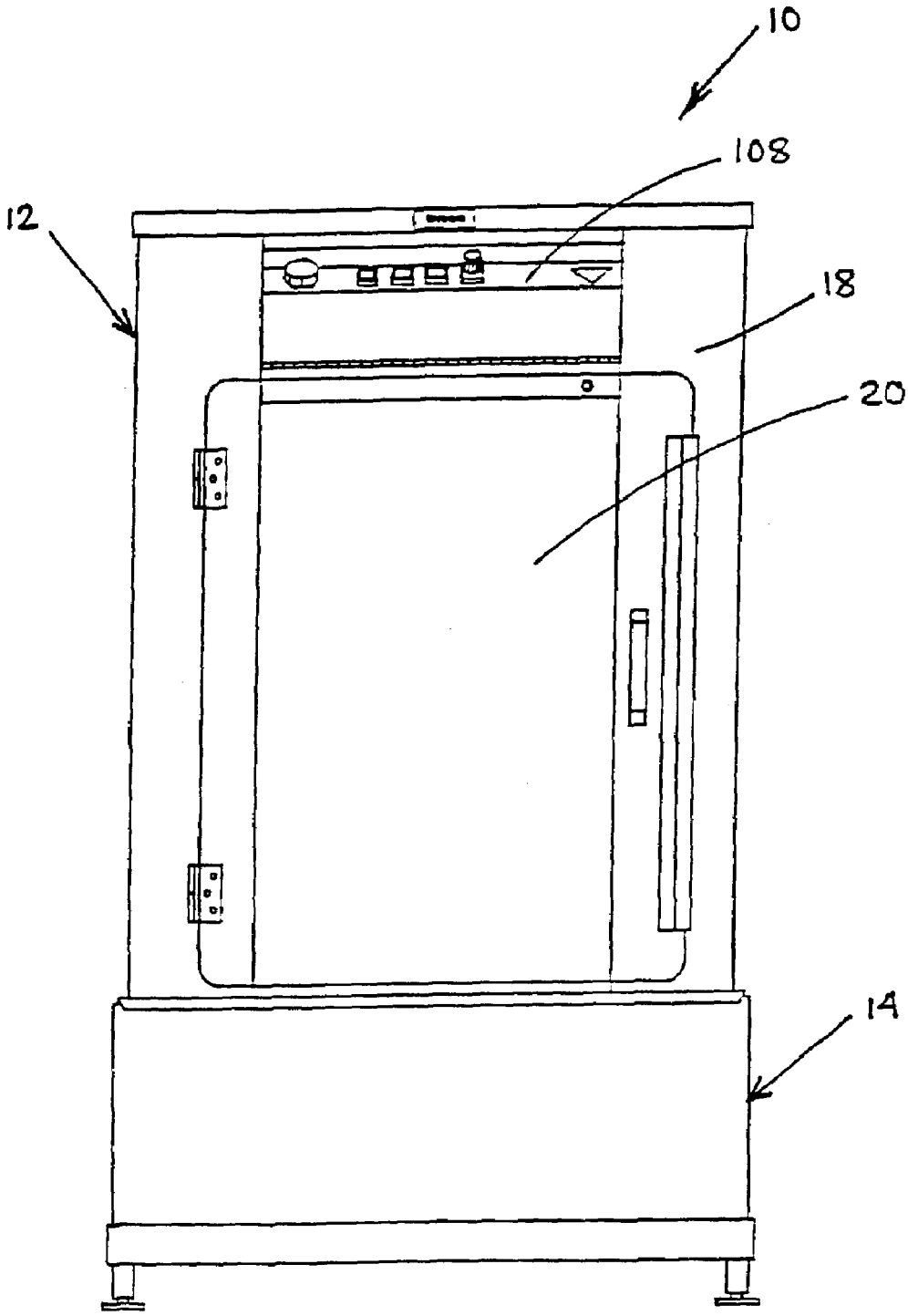
FIG. 1 shows a front view of a mixing apparatus.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the term "conventional one gallon paint container" shall mean a cylindrical steel container for holding paint, having an interior volume of slightly greater than 1 gallon, a diameter of about 6⁹⁄₁₆ inches and a height of about 7⅝ inches, and including a bail handle secured to a pair of mounting ears.

As used herein, the term "conventional five gallon paint container" shall mean a cylindrical plastic container for holding paint, having an interior volume of slightly greater than 5 gallons, a diameter of about 12 inches and a height of about 14½ inches.

Referring now to FIG. 1, there is shown a mixing apparatus 10 embodied in accordance with a first embodiment of the present invention. The mixing apparatus 10 is specially adapted to mix a fluid dispersion, such as paint, that is disposed in a conventional five gallon paint container or a conventional one gallon paint container, as well as an unconventional one gallon plastic paint container. For proper operation, the mixing apparatus 10 should be disposed on a substantially horizontal surface, and in the following description, it will be assumed that the mixing apparatus 10 is so disposed.

Figure 2:
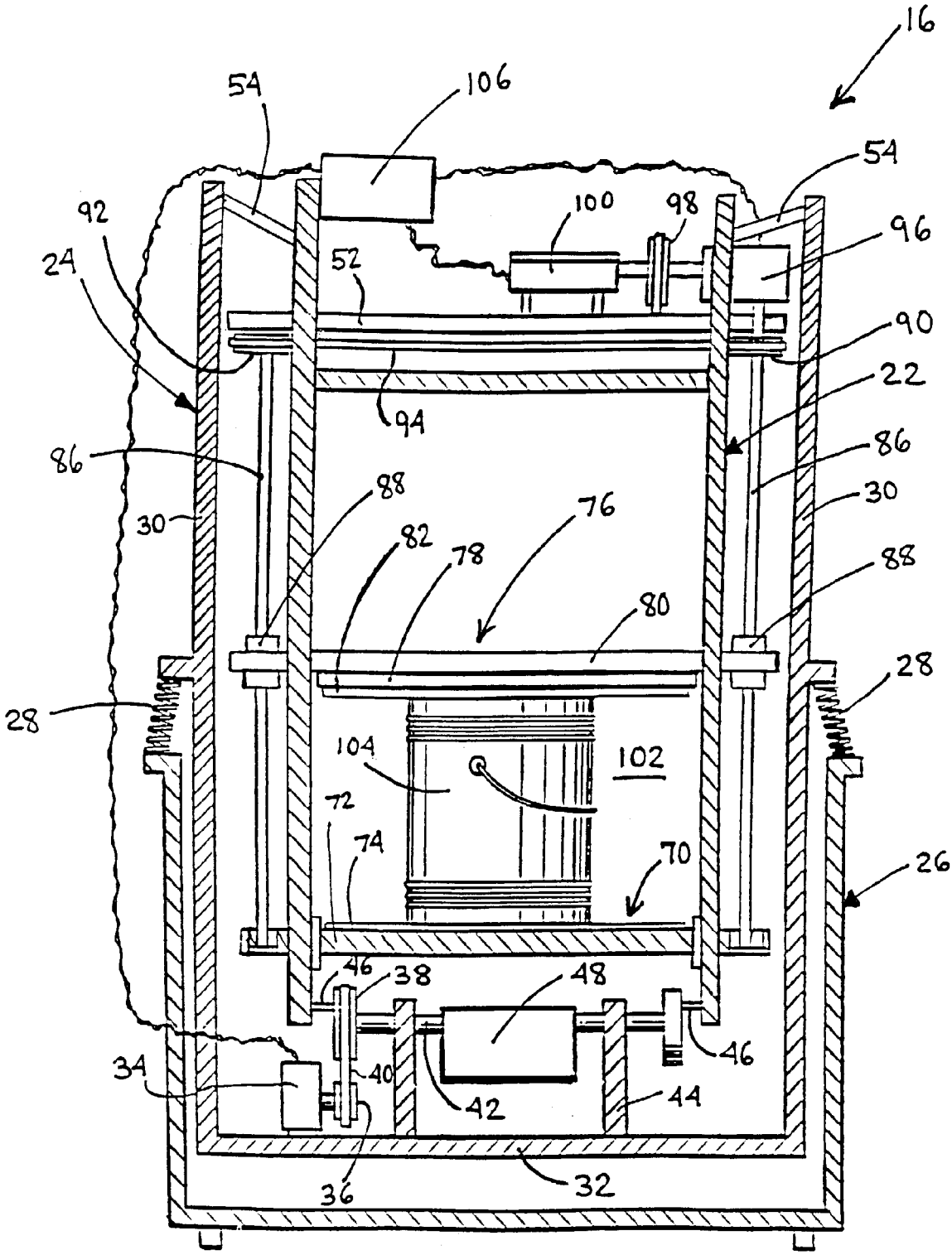
FIG. 2 shows a schematic cross-sectional view of a frame assembly of the mixing apparatus.
Figure 3:
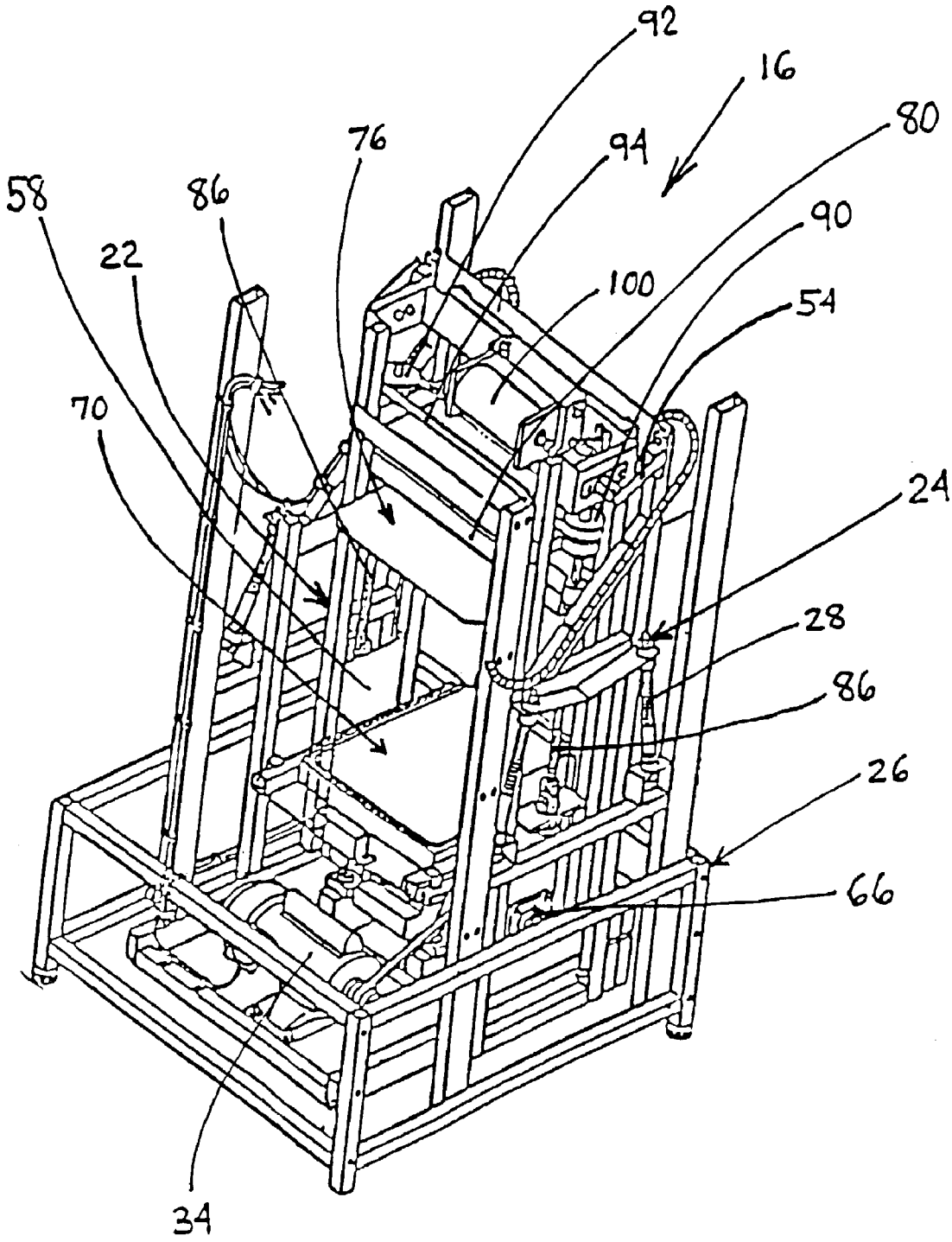
FIG. 3 shows a perspective view of the frame assembly.
Figure 4:
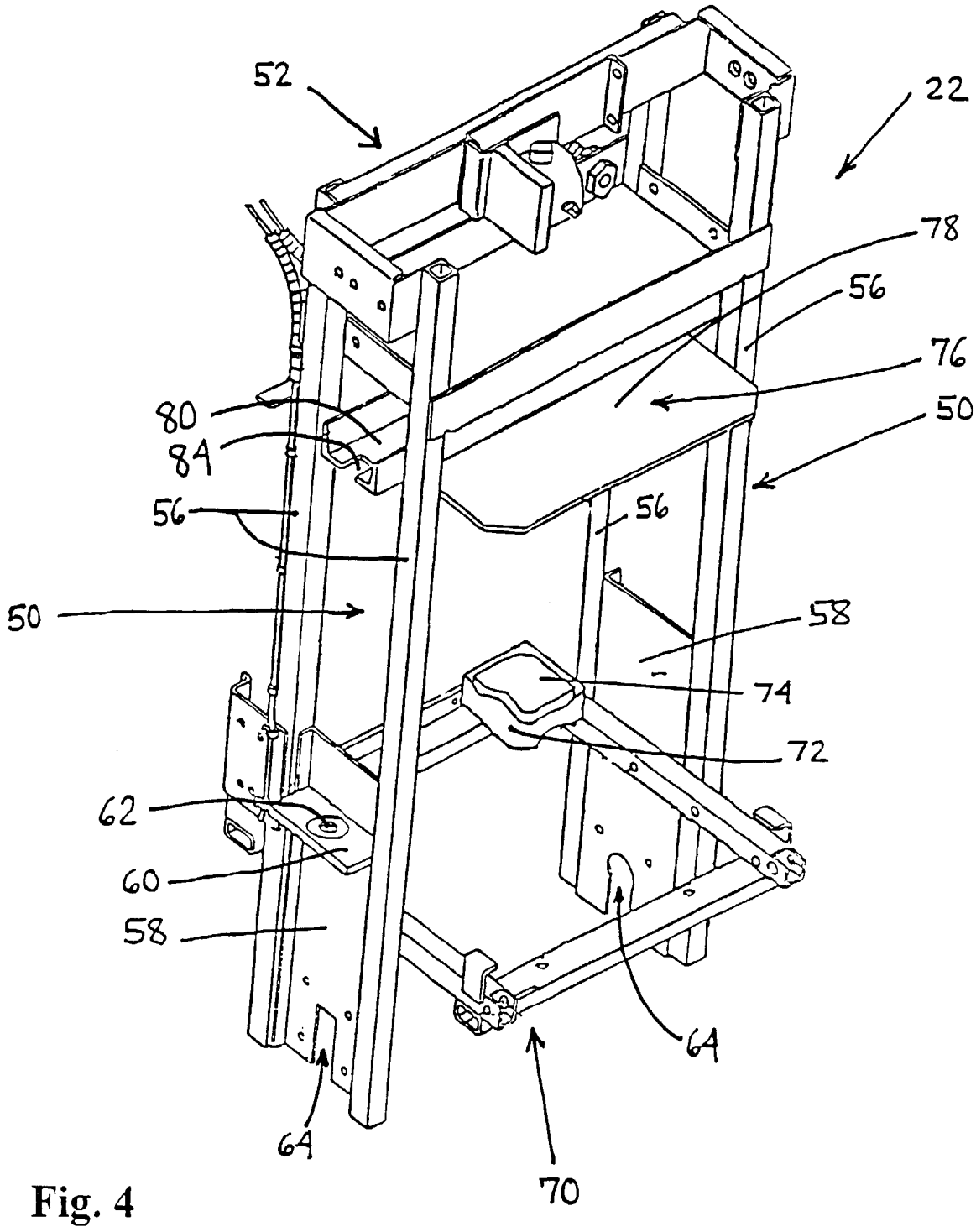
FIG. 4 shows a perspective view of an inner frame of the frame assembly.

The mixing apparatus 10 has an upper housing 12 and a lower housing 14 that enclose a frame assembly 16 (shown in FIGS. 2, 3 and 4). The upper housing 12 includes a front wall 18 secured to side walls of a wrapper (not shown). The front wall 18 defines an enlarged opening that is closed by a pivotable door 20.

Referring now to FIG. 2, there is shown a schematic cross-sectional view of the frame assembly 16, which includes inner, middle, and outer frames 22, 24, 26. The middle frame 24 is suspended by springs 28 in the outer frame 26. The middle frame 24 includes a pair of opposing side structures 30 secured to a bottom structure 32. An electric shaking motor 34 is mounted to the bottom structure 32 and is operable to rotate a drive pulley 36 that is drivingly connected to a larger diameter crankshaft pulley 38 by an endless belt 40. The crankshaft pulley 38 is secured to a crankshaft 42 that is rotatably mounted to a bearing mount 44 secured to the bottom structure 32. The crankshaft 42 has opposing ends with eccentric pins 46 extending therefrom. The eccentric pins 46 are connected to the inner frame 22, as described below. An eccentric counterweight 48 is secured to a middle portion of the crankshaft 42 and is offset 180° from the pins 46. The counterweight 48 balances the forces generated by the movement of the inner frame 22 and any container disposed therein. When the shaking motor 34 is energized, the inner frame 22 is subjected to a vibration, the path of which can be considered pear shaped.

Referring now also to FIGS. 3 and 4, the inner frame 22 includes a pair of opposing side structures 50 secured to a top structure 52. Opposing ends of the top structure 52 are respectively connected to the side structures 30 of the middle frame 24 by pivotable links 54. Each of the side structures 50 includes a pair of vertically-extending posts 56 with bottom portions having a bearing plate 58 secured therebetween. Rod mounting plates 60 are joined perpendicularly to outer surfaces of the bearing plates 58 and extend outwardly therefrom in cantilever fashion. Each of the mounting plates 60 has a vertically extending opening 62 formed therein. The bearing plates 58 include downwardly-opening slots 64 over which bearing assemblies 66 are secured. The eccentric pins 46 of the crankshaft 42 extend through the slots 64 and the bearing assemblies 66, thereby connecting the eccentric pins 46 to the bearing plates 58, respectively.

A table 70 is mounted between the bottom portions of the side structures 50 for slidable movement between a retracted position, wherein a major portion of the table 70 is disposed within the inner frame 22, and an extended position, wherein a major portion of the table 70 is disposed outside and in front of the inner frame 22. The table 70 includes a metal plate 72 having a top surface to which a rubber pad 74 is preferably secured. The rubber pad 74 preferably has a thickness of about a ¼ inch.

Figure 5:
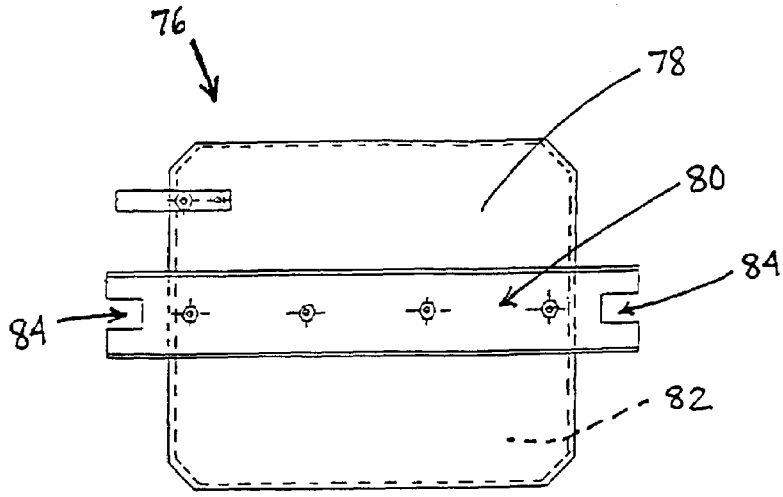
FIG. 5 shows a top view of a clamp assembly of the mixing apparatus.
Figure 6:
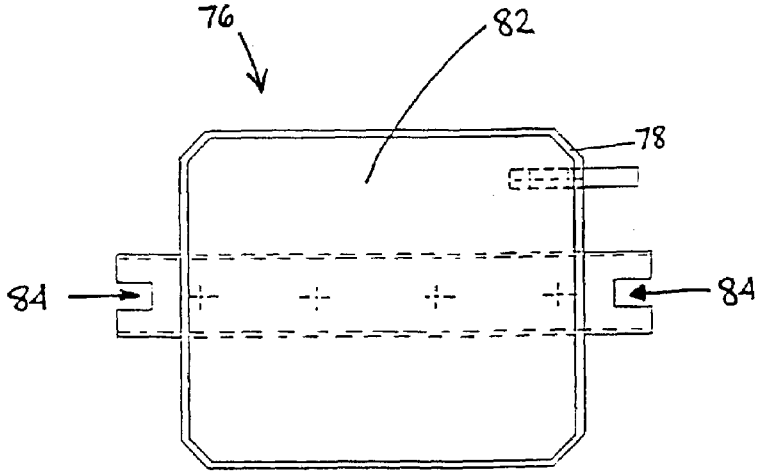
FIG. 6 shows a bottom view of the clamp assembly.
Figure 7:
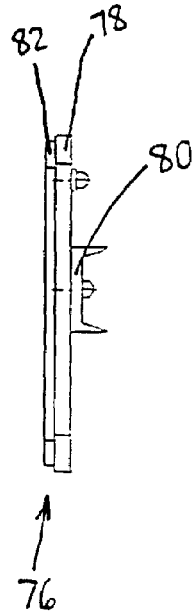
FIG. 7 shows a side view of the clamp assembly.

A clamp assembly 76 is disposed between the side structures 50, above the table 70. As best shown in FIG. 5, the clamp assembly 76 includes a generally rectangular clamping plate 78 secured to a channel-shaped upper bar 80. A rubber pad 82 is secured to a bottom surface of the clamping plate 78. The rubber pad 82 preferably has a thickness of about a ¼ inch. Side edges of the clamping plate 78 are disposed inwardly from the posts 56 of the side structure 50. In this manner the clamping plate 78 is fully disposed between the side structures 50 in a lateral direction. In contrast, the upper bar 80 extends between the posts 56 and over the rod mounting plate 60 of each side structure 50. Outwardly-opening notches 84 are formed in the ends of the upper bar 80.

A pair of threaded rods 86 extend through the notches 84 in the ends of the upper bar 80. The rods 86 extend through and are threadably engaged with nuts 88 that are secured to the upper bar 80 around the notches 84. Lower portions of the rods 86 extend through the openings 62 in the rod mounting plates 60 and are secured to the screw mounting mounting plates 60 to permit rotational, but not axial, movement of the rods 86. First and second pulleys 90, 92 are secured to top ends of the rods 86 and are connected together by an endless belt 94. The first pulley 90 is connected by a coupling to a substantially vertical output shaft of a gearbox 96. A horizontal input shaft of the gearbox 96 is connected by a coupling 98 to a drive shaft of a reversible electric clamping motor 100. The gear box 96 and the clamping motor 100 are secured to the top structure 52 of the inner frame 22.

The gear box 96 is operable to translate the rotation of the drive shaft of the clamping motor 100 into rotation of the first pulley 90. The rotation of the first pulley 90, in turn, is transmitted to the second pulley 92 by the endless belt 94. In this manner, the clamping motor 100 is operable to rotate both of the rods 86. Since the clamping motor 100 is reversible, the clamping motor 100 can rotate the rods 86 in two different directions. When the rods 86 are rotating in a first direction, the nuts 88 secured to the upper bar 80 travel up the threads on the rods 86, thereby moving the clamp assembly 76 upward. Conversely, when the rods 86 are rotating in a second direction, the nuts 88 travel down the threads on the rods 86, thereby moving the clamp assembly 76 downward. The clamp assembly 76 is movable between an uppermost position and a lowermost position.

The table 70 and the clamping plate 78 with the rubber pad 74 secured thereto respectively define lower and upper limits of a holding space 102 in which a container, such as a container 104, may be disposed for shaking. The height of the holding space 102 is varied by movement of the clamp assembly 76 in response to the rotation of the rods 86. The holding space 102 has a maximum height when the clamp assembly 76 is in the uppermost position and has a minimum height when the clamp assembly 76 is in the lowermost position. As will be described more fully below, blocking structures 112 (shown in FIGS. 8-10) determine the lowermost position of the clamp assembly 76 and, thus, the minimum height of the holding space 102. The maximum height of the holding space 102 is preferably from about 16 to about 25 inches, more preferably from about 17 to about 18 inches. As will be described below, the minimum height of the holding space 102 is preferably about 7½ inches. The minimum height of the holding space 102 as a percentage of the maximum height of the holding space 102 is from about 30% to about 50%, more preferably from about 40% to about 44%. The holding space 102 has a lateral width and depth sized to at least accommodate a case of four conventional one gallon paint containers.

A control system 106 is provided for controlling the operation of the mixing apparatus 10 in response to manual actuation of input devices, such as pushbuttons and timers, located on a control panel 108 (shown in FIG. 1) mounted on the front wall 18 of the upper housing 12. The control system 106 may have the construction and operation of the control system disclosed in U.S. Pat. No. 5,268,620 or the construction and operation of the control system disclosed in U.S. Pat. No. 4,134,689. The control system 106 is electrically connected to the clamping motor 100 and the shaking motor 34 for controlling the supply of electric power thereto. The control system 106 controls the direction of current flow through the clamping motor 100 and, hence, its direction of rotation, thereby permitting the control system 106 to control the clamping and release of a container disposed in the holding space 102.

The control system 106 monitors the current drawn by the clamping motor 100, which is an indication of the force being applied by the clamp assembly 76. When the current reaches a predetermined maximum level, which corresponds to a predetermined maximum amount of force being applied by the clamp assembly 76, the control system 106 controls the clamping motor 100 to maintain a clamping pressure that does not exceed the maximum amount of force.

If the control system 106 has the construction and operation of the control system of U.S. Pat. No. 5,268,620, the control system 106 can be programmed to reverse the polarity of the clamping motor 100 when the current reaches the predetermined maximum level, thereby backing the clamp assembly 76 off a small amount. Thereafter, the control system 106 reverses the polarity of the clamping motor 100 to again have the clamp assembly 76 apply pressure. Power to the clamping motor 100 may then be "chopped" according to a pre-defined duty cycle. During the "on" portions of the operating cycle of the clamping motor 100, the power supplied to the clamping motor 100 is substantially less than the full power that can be supplied to the clamping motor 100.

If the control system 106 has the construction and operation of the control system of U.S. Pat. No. 4,134,689, when the current reaches the predetermined maximum level, the control system 106 either cuts off electric power to the clamping motor 100 or limits the current to the predetermined maximum level.

Figure 9:
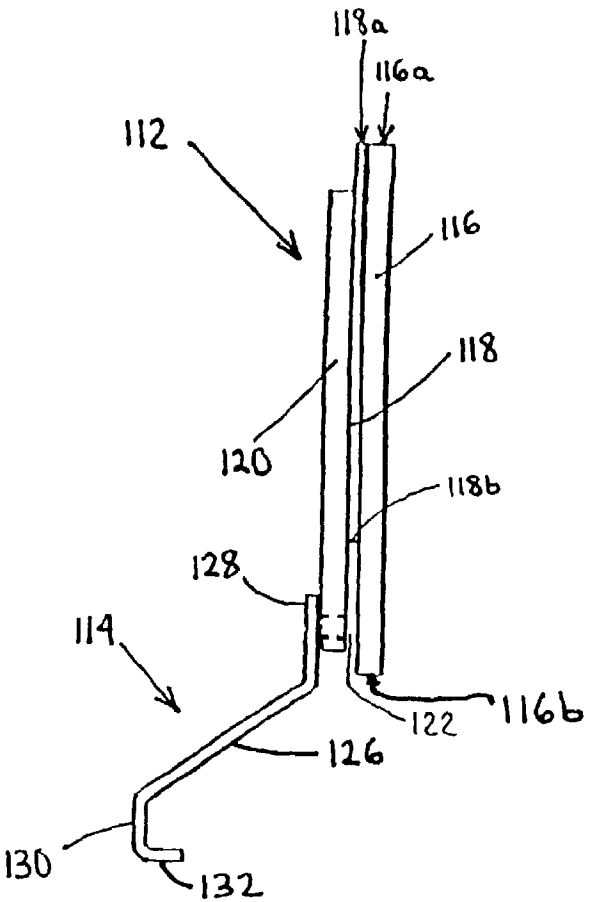
FIG. 9 shows a side view of the hard stop assembly.
Figure 8:
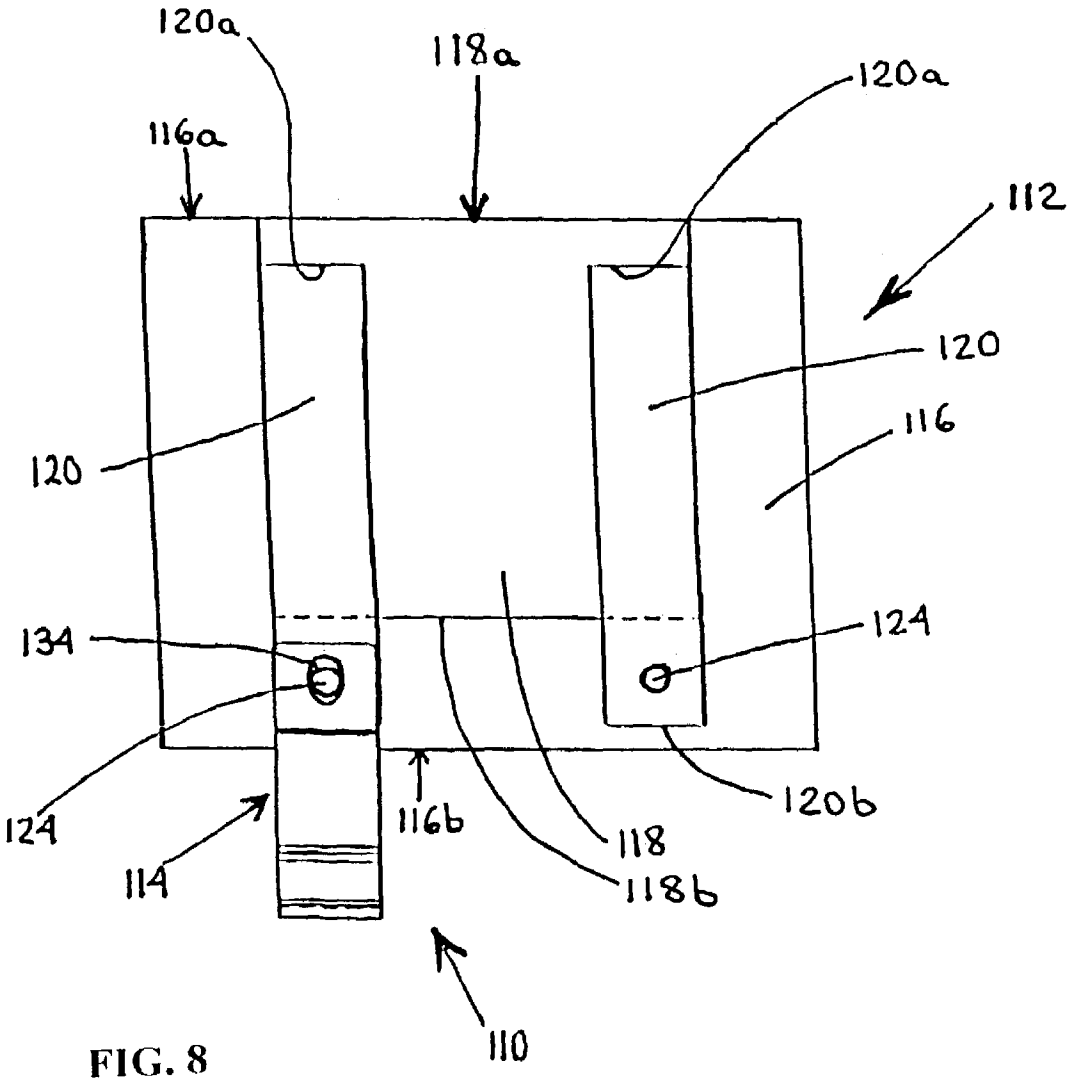
FIG. 8 shows a rear view of a hard stop assembly.

A pair of hard stop assemblies 110 is provided for securement to the bearing plates 58 of the side structures 50. As will be described more fully below, the hard stop assemblies 110 are provided to contact the upper bar 80 of the clamp assembly 76 to stop the downward movement of the clamp assembly 76. Referring now to FIGS. 8 and 9, each hard stop assembly 110 generally includes a blocking structure 112 and a securement clip 114.

Each blocking structure 112 includes a stop plate 116 having front and rear surfaces and top and bottom edges **116*a*, 116*b*. The stop plate 116 is rigid and is composed of metal, preferably steel. The stop plate 116 has a thickness of about a ¼ inch and a width slightly less than the width between the posts 56. A spacer plate 118 is secured by welding or otherwise to the rear surface of the stop plate 116. The spacer plate 118 has a top 118*a* edge that is aligned with the top edge 116*a* of the stop plate 116 and a bottom edge 118*b* that is spaced upwardly from the bottom edge 116*b* of the stop plate 116. The top edges 116*a*, 118*a* of the stop plate 116 and the spacer plate 118, respectively, cooperate to define a top contact surface. A pair of spaced-apart mounting legs 120 are secured by welding or otherwise to the spacer plate 118. The mounting legs 120 have upper ends 120*a* spaced downwardly from the top edge 118*a* of the spacer plate 118 and lower ends 120*b* spaced downwardly from the bottom edge 118*b* of the spacer plate 118. In this manner, lower portions of the mounting legs 120 extend below the bottom edge 118*b* of the spacer plate 118 so as to define a pair of downwardly-opening slots 122 between the mounting legs 120 and the stop plate 116, with the lower edge of the spacer plate 118*b* forming closed ends for the slots 122. A pair of threaded openings 124 are formed in the mounting legs 120, toward the lower ends 120*b***.

The securement clip 114 is composed of metal, preferably steel, and includes a sloping middle section 126 joined between a vertical top section 128 and an L-shaped bottom section 130. The bottom section 130 includes an inwardly-extending bottom leg 132. An opening 134 is formed in the middle section 126.

Figure 10:
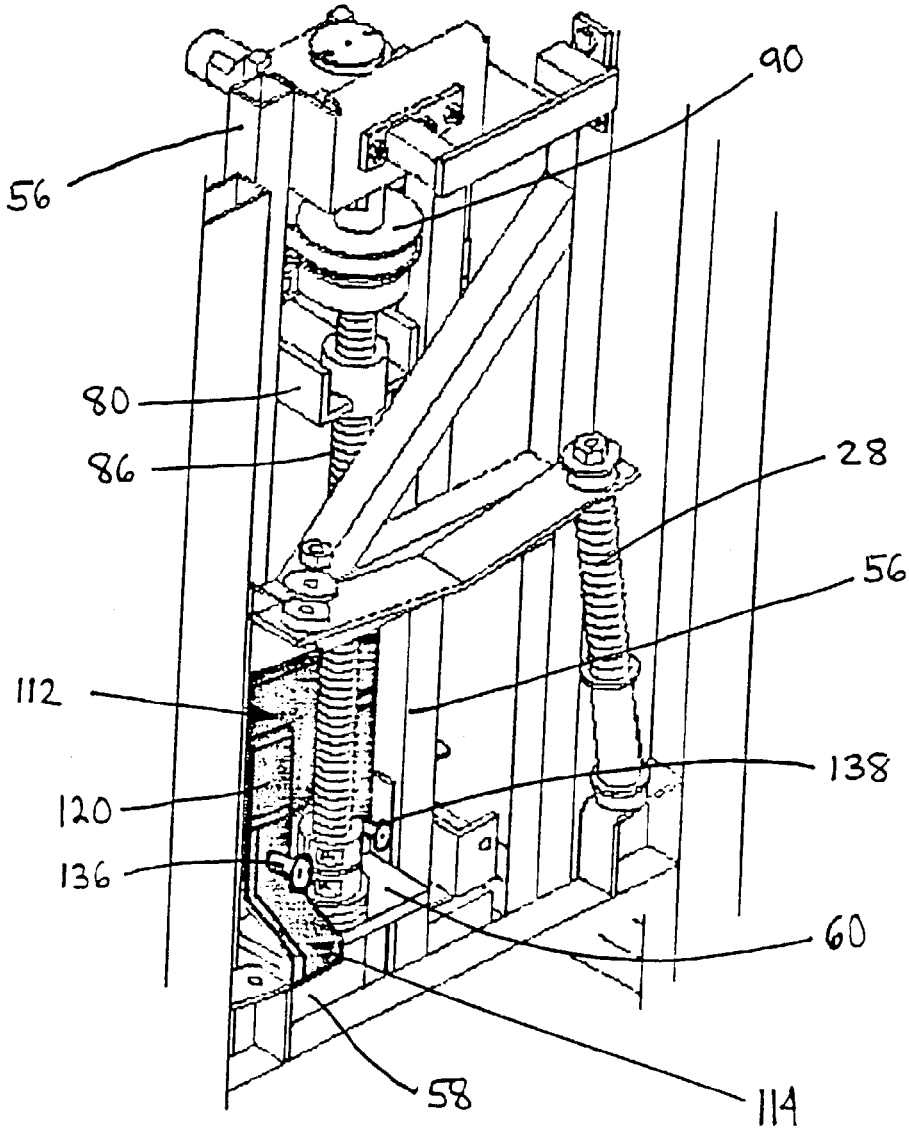
FIG. 10 shows a side view of a portion of the frame assembly, with a hard stop assembly mounted therein.

The hard stop assemblies 110 are mounted to the bearing plates 58, respectively. Referring now to FIG. 10, one of the hard stop assemblies 110 is shown mounted to its bearing plate 58. The blocking structure 112 is disposed over a top portion of the bearing plate 58, such that the top portion of the bearing plate 58 is in the slot 122 and the lower edge **118*b* of the spacer plate 118 is resting on the top edge of the bearing plate 58. With the blocking structure 112 so positioned, the top portion of the bearing plate 58 is trapped between the stop plate 116 and the mounting legs 120. The securement clip 114 is engaged with the rod mounting plate 60 such that an outer edge portion of the rod mounting plate 60 is disposed between a lower end of the middle section 126 and the bottom leg 132 of the bottom section 130 of the securement clip 114. The opening 134 in the top section 128 of the securement clip 114 is aligned with the opening 124 (as shown in FIG. 8) in a front one of the mounting legs 120 of the blocking structure 112. A screw 136 threadably extends through the openings 124, 134 and has a free end pressed against the top portion of the bearing plate 58, thereby securing the securement clip 114 to the blocking structure 112 and helping to secure the blocking structure 112 to the bearing plate 58. Another screw 138 threadably extends through the opening 124 in a rear one of the mounting legs 120 and has a free end pressed against the top portion of the bearing plate 58, thereby also helping to secure the blocking structure 112 to the bearing plate 58. The securement clip 114 helps secure the blocking structure 112 to the bearing plate 58 and helps support the blocking structure 112** against lateral movement.

With the hard stop assemblies 110 mounted in the mixing apparatus 10 as described above, the hard stop assemblies 110 are disposed to the sides of the clamping plate 78. In this manner, the hard stop assemblies 110 do not reduce the lateral width of the holding space 102, which permits the holding space 102 to still accommodate a case of four conventional one gallon paint containers.

The contact surfaces of the blocking structures 112 are positioned at a height A above the table 70. Height A is selected such that the contact surfaces contact the upper bar 80 of the clamp assembly 76 and stop further downward movement of the clamp assembly 76 to provide a holding space 102 that can tightly hold a conventional one gallon paint container. The height A is based upon a number of factors, namely the height B of a conventional one gallon paint container, the thickness C of the clamping plate 78, the thickness D of the rubber pad 82, and the amount of compression E the rubber pads 74, 82 can undergo. More specifically, the height of the contact surface is determined from the following relationship.

$$A=B+C+D-E$$

Preferably, the thickness C of the clamping plate 78 is about 5/16 of an inch, the thickness D of the rubber pad 82 is about 4/16 of an inch and the compression E of the rubber pads 74, 82 is about 2/16 of an inch (1/16 of an inch for each of the rubber pads 74, 82). Based on the foregoing relationship, the height A is about 8 1/16 inches, which would provide a holding space 102 of about 7½ inches.

When a conventional 1 gallon paint container is disposed on the table 70 and the clamp assembly 76 is moved downward into contact with the paint container, the paint container is pressed into the rubber pads 74, 82 until the upper bar 80 contacts the contact surfaces of the blocking structures 112, which stops the downward movement of the clamp assembly 76, thereby establishing the lowermost position of the clamp assembly 76 and, thus, the minimum height of the holding space 102. The force applied by the clamp assembly 76 on the blocking structures 112 increases until the predetermined maximum amount of force is reached, at which point the control system 106 controls the clamping motor 100 to maintain a clamping pressure on the blocking structures 112 that does not exceed the maximum amount of force. With the paint container so positioned between the clamp assembly 76 and the table 70, the paint container is secured from movement. The shaking motor 34 may then be activated to shake the contents of the paint container.

Figure 11:
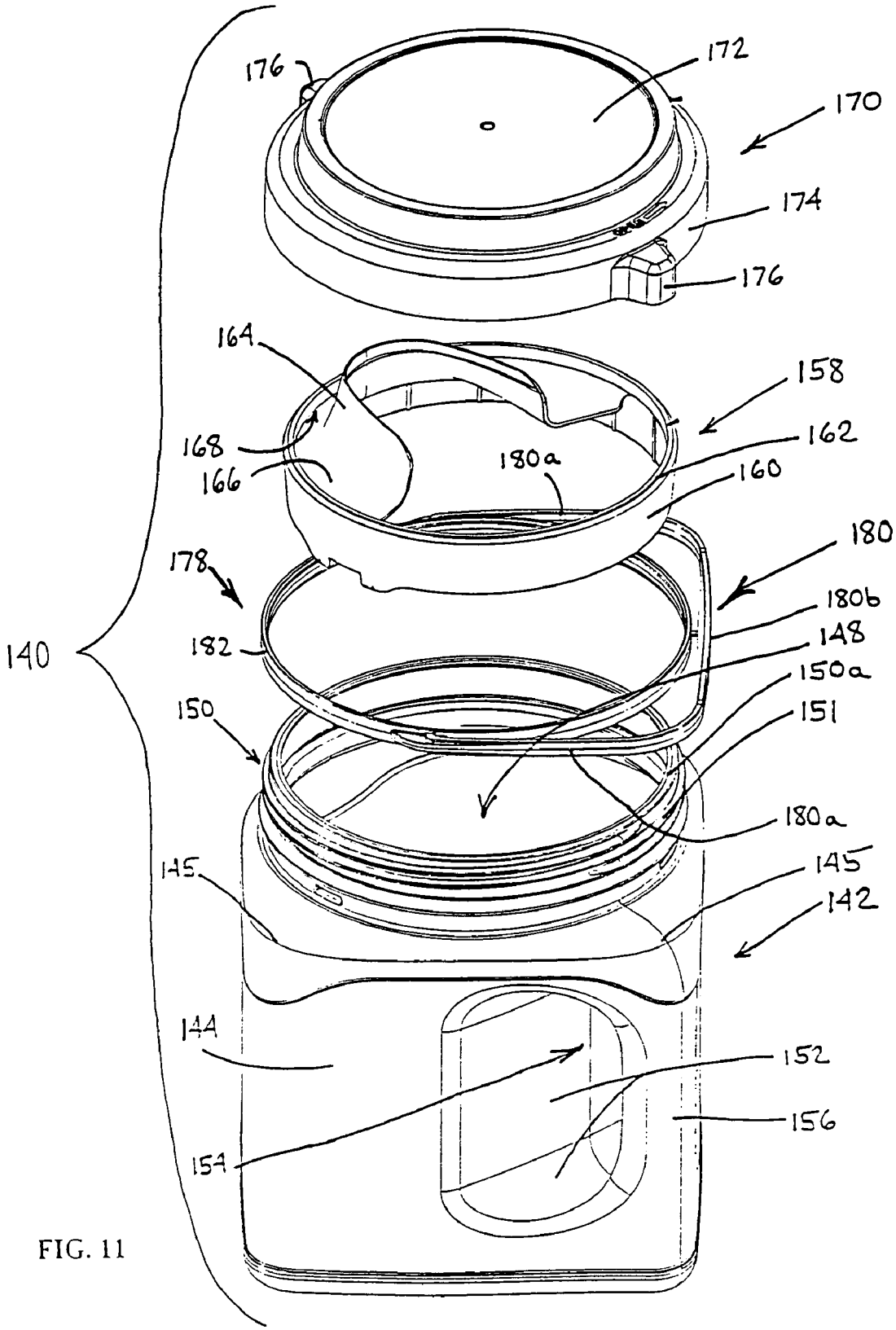
FIG. 11 shows an exploded view of a plastic container which may be used in the mixing apparatus.

Referring now to FIG. 11, there is shown an exploded view of a plastic container 140 that may be used in the mixing apparatus 10. The container 140 comprises a plastic body 142 having a generally square shape with generally square side walls 144. The body 142 is preferably blow molded from high density polyethylene. The side walls 144 have a thickness of about 0.06 inches and are joined at three rounded corners 145 having a radius of curvature of about 0.8 inches and a sloping front corner (not shown) having a radius of curvature of about 2.1 inches. The body 142 also includes a bottom wall (not shown) and a top wall 146 with an enlarged opening formed therein. The top wall 146 and the bottom wall have a thickness of about 0.06 inches. A collar 150 with an external thread 151 is disposed around the opening in the top wall 146 and extends upwardly therefrom. The collar 150 terminates in an upper rim 150*a* defining an access opening 148, which is sized to permit a conventional paint brush to extend therethrough. More specifically, the access opening 148 preferably has a diameter greater than about 4 inches, more preferably greater than about 5 inches.

The body 142 has a plurality of inner walls. 152 defining a handle passage 154. A handle 156 is formed at a corner of the body 142 and extends vertically across the handle passage 154. An innermost one of the inner walls 152 that defines the handle passage 154 is disposed laterally inward from the collar 150. In this manner, a portion of the handle passage 154 is disposed laterally inward from the collar 150.

A pouring insert 158 is provided for removable mounting in the access opening 148 of the container 140. The pouring insert 158 comprises an annular mounting ring 160 having a skirt 162 for disposal over the upper rim 150*a* of the container 140. A pour spout 164 is disposed radially inward from the mounting ring 160 and is joined thereto by a curved wall 166. The pour spout 164 is generally semi-circular and extends above the upper rim 150*a*. The apex of the pour spout 164 is spaced about ½ an inch from the upper rim 150*a* when the pouring insert is properly disposed in the access opening 148. The curved wall 166 slopes downwardly as it extends rearwardly, toward the handle 156. The curved wall 166, the mounting ring 160 and the pour spout 164 define a drainage groove 168 that collects paint drips from the pour spout 164 and permits the collected paint to flow back into the container 140.

A tiered lid 170 is provided for closing the access opening 148. The lid 170 comprises a cylindrical top portion 172 joined to a larger cylindrical bottom portion 174. The bottom portion 174 has an internal thread (not shown) for engaging the threads 151 of the collar 150 to threadably secure the lid 170 to the collar 150. A pair of grip tabs 176 extend radially outward from an outside surface of the bottom portion 174.

The width of the container 140 is substantially the same as the diameter of a conventional one gallon paint container, namely about 6 9/16 inches. The height of the container 140, up to the top of the lid 170 (when it is securely threaded to the collar 150) is about 7⅞ inches. The interior volume of the container 140 is slightly greater than 1 gallon.

The container 140 includes a bail handle structure 178 composed of plastic and comprising a bail handle 180 integrally joined at opposing ends to an annular band 182. The handle 180 is generally rectangular and has two legs 180*a* joined to opposing ends of a central member 180*b* so as to be generally perpendicular thereto. Preferably, the band 182 is constructed to be expandable so that the band 182 can be snapped over the collar 150 and trapped under a lowermost turn of the threads 151. The band 182 can be rotated around the collar 150 between a flush position, wherein the legs 180*a* and central member 180*b* are substantially parallel to and flush with the side walls 144 of the body 142, and an extended position, wherein the legs 180*a* and the central member 180*b* are disposed at oblique angles to the side walls 144, thereby forming protruding loops. The bail handle 180 can be flexed to a carrying position, wherein the handle 180 is substantially perpendicular to the band 182.

When the container 140 is placed on the table 70 and the clamp assembly 76 is moved downward into contact with the container 140, the container 140 is pressed into the rubber pads 74, 82 and the container 140 itself compresses until the upper bar 80 contacts the contact surfaces of the blocking structures 112, which stops the downward movement of the clamp assembly 76. The force applied by the clamp assembly 76 on the blocking structures 112 increases until the predetermined maximum amount of force is reached, at which point the control system 106 controls the clamping motor 100 to maintain a clamping pressure on the blocking structures 112 that does not exceed the maximum amount of force. With the container 140 so positioned between the clamp assembly 76 and the table 70, the container 140 is secured from movement and is vertically compressed about ¼ of an inch so as to have a height of only about 7⅜ inches. The structure of the container 140 permits the container 140 to withstand the compression without rupturing or otherwise being damaged and permits the container 140 to resiliently return to its original shape when the clamp assembly 76 is moved upward and away from the container 140.

Figure 12:
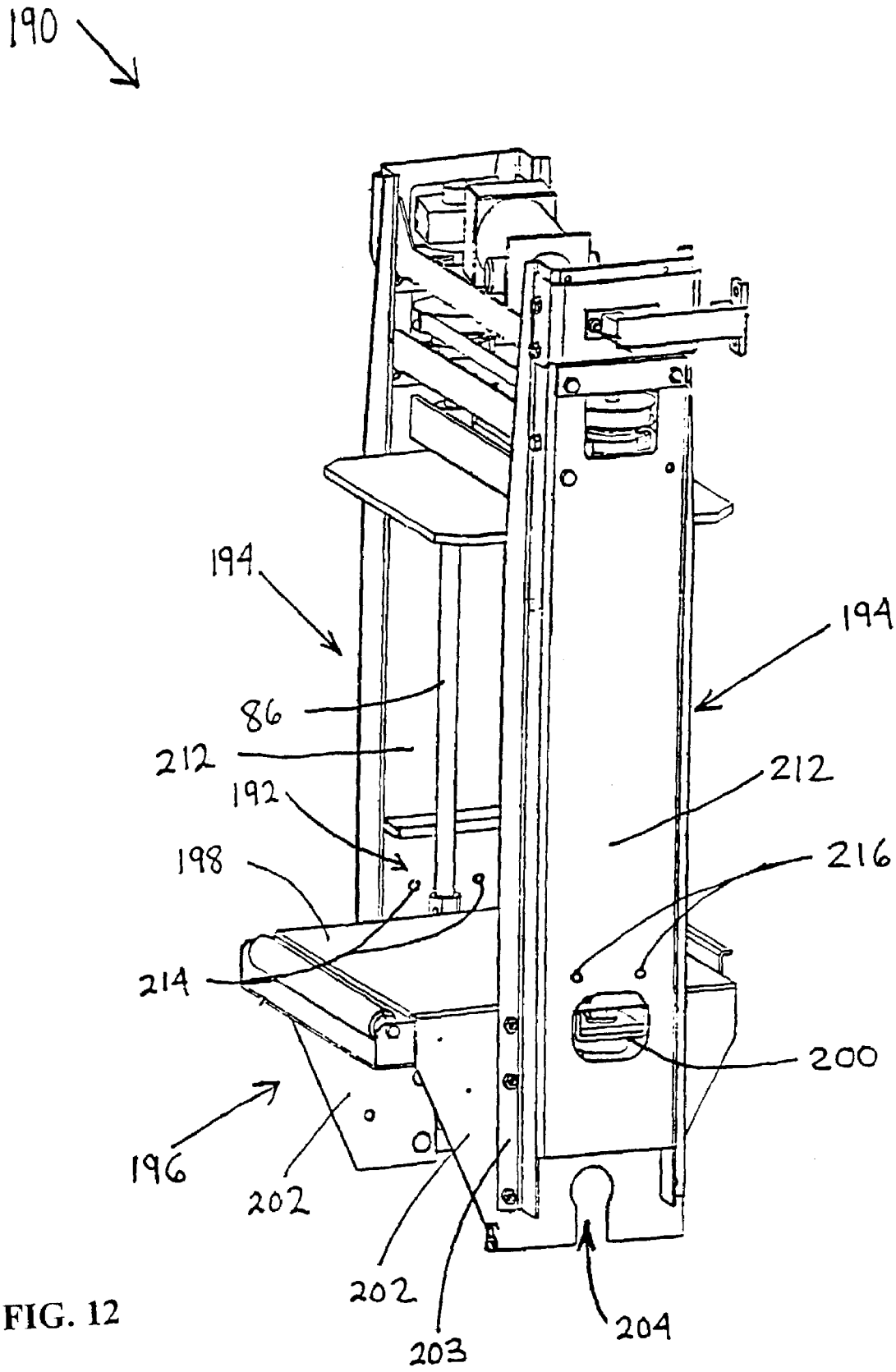
FIG. 12 shows a side perspective view of a portion of a mixing apparatus constructed in accordance with a second embodiment of the present invention.
Figure 13:
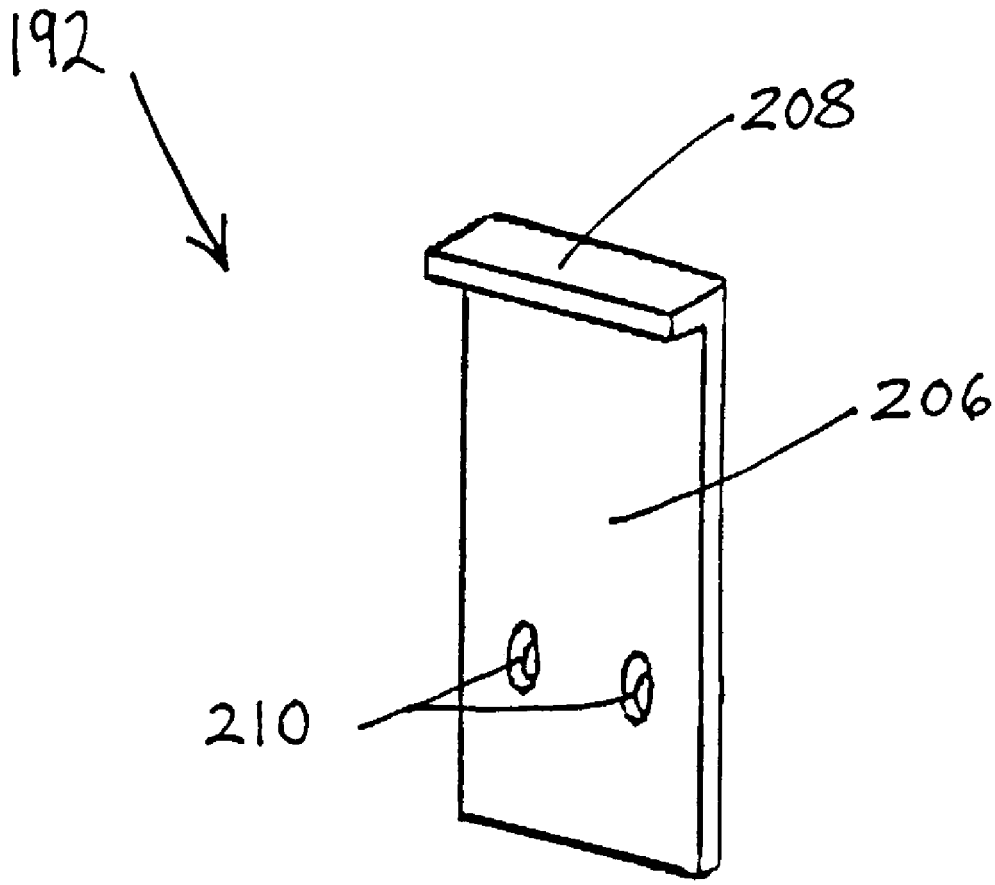
FIG. 13 shows a perspective view of a blocking plate for use in the mixing apparatus of the second embodiment.

Referring now to FIG. 12, there is shown a portion of a mixing apparatus 190 embodied in accordance with a second embodiment of the present invention. The mixing apparatus 190 has the same construction as the mixing apparatus 10 of the first embodiment, except for the differences described below. Instead of having the hard stop assemblies 110, the mixing apparatus 190 has a pair of blocking plates 192 (one of which is shown in FIG. 13), and instead of having the side structures 50 comprising the posts 56, rod mounting plates 60 and bearing plates 58, the mixing apparatus 190 has a pair of channel-shaped side plates 194. In addition, instead of having the table 70, the mixing apparatus has a fixed table 196, which includes a metal plate 198 secured on top of a laterally-extending channel-shaped bar 200. Outer ends of the bar 200 are spaced laterally outward from the plate 198 and form a pair of rod mounting structures, respectively. Each of the rod mounting structures has an opening (not shown) extending therethrough. Lower portions of the rods 86 extend through the openings in the rod mounting structures and are secured to the screw mounting structures to permit rotational, but not axial, movement of the rods 86.

A pair of mounting legs 202 are secured to the plate 198 and extend downwardly therefrom. The mounting legs 202 are secured to side flanges 203 of the side plates 194. Lower ends of the mounting plates 198 include downwardly-opening slots 204 over which the bearing assemblies 66 are secured. The eccentric pins 46 of the crankshaft 42 extend through the slots 204 and the bearing assemblies 66, thereby connecting the eccentric pins 46 to the mounting legs 202 of the table 196, respectively.

Referring now also to FIG. 13, each of the blocking plates 192 generally has an inverted L-shape, including a center plate 206 with a flange 208 extending inwardly from a top end thereof. A pair of openings 210 are formed in the center plate 206, toward a bottom end thereof The blocking plates 192 are positioned over interior surfaces of center members 212 of the side plates 194 such that the flanges 208 extend inwardly and the openings 210 in the center plates are aligned with openings in the center members 212 of the side plates 194. Bolts 214 extend through the aligned openings and are fitted with nuts 216 threadably secured over their free ends, thereby securing the blocking plates 192 to the side plates 194.

Top surfaces of the flanges 208 of the blocking plates 192 are positioned at a height above the table 196 that is selected as set forth above with regard to the mixing apparatus 10, except that the table 196 does not have a rubber pad, which decreases the amount of compression E that is available. The blocking plates 192 function in the same manner as the hard stop assemblies 110.

As can be appreciated from the foregoing description of the invention, in each of the mixing apparatuses 10, 190, the control system 106 limits the downward motion of the clamp assembly 76 in the manner described above when a conventional five gallon paint container is being clamped to the table 70 or the table 196, whereas the hard stop assemblies 110 or the blocking plates 192 limit the downward motion of the clamp assembly 76 in the manner described above when a conventional one gallon paint container or the plastic container 140 is being clamped to the table 70 or the table 196.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. Apparatus for mixing a fluid dispersion, said apparatus comprising:

a container containing a fluid dispersion;

a table upon which the container may be disposed;

a clamp assembly disposed above the table so as to define a holding space therebetween, said clamp assembly comprising an upper bar and being movable between an uppermost position and a lowermost position, wherein when the clamp assembly is in the uppermost position, the holding space has a maximum height and when the clamp assembly is in the lowermost position, the holding space has a minimum height;

a first electric motor connected to the clamp assembly for moving the clamp assembly toward and away from the table so as to change the height of the holding space;

a second electric motor connected to the table for vibrating the table, thereby mixing the fluid dispersion in the container;

a control system electrically connected to the first electric motor and operable to control the first electric motor so as to move the clamp assembly downward into clamping engagement with the container and maintain a clamping pressure that does not exceed a predetermined maximum amount;

at least one blocking structure comprising a top contact surface, wherein said blocking structure is disposed between the table and the clamp assembly to limit the downward movement of the clamp assembly and thereby establish the lowermost position of the clamp assembly, wherein the blocking structure is positioned to provide that the minimum height of the holding space is at least 30% of the maximum height of the holding space, wherein said blocking structure is detached from the container; and wherein the lowermost position of the clamp assembly is defined by contact of the upper bar with the contact surface of the blocking structure.

2. The apparatus of claim 1, wherein the blocking structure is positioned to provide that the minimum height of the holding space is from about 40% to about 44% of the maximum height of the holding space.

3. A method of mixing a fluid dispersion disposed in a plastic container, said method comprising the steps of:

(a.) providing an apparatus comprising:

a table;

a clamp assembly disposed above the table; and a blocking structure disposed between the table and the clamp assembly, said blocking structure having a top end disposed at a height above the table that is less than the height of the container, and wherein said blocking structure is detached from the container;

(b.) placing the container on the support surface of the table;

(c.) moving the clamp assembly downward into contact with the blocking structure, thereby compressing the container; and (d.) vibrating the table, thereby mixing the fluid dispersion in the container.

4. A method of mixing a fluid dispersion disposed in a first container and a fluid dispersion disposed in a shorter second container, said method comprising the steps of:

(a.) providing an apparatus comprising:

a table:

a clamp assembly movably disposed above the table;

an electric motor for moving the clamp assembly toward and away from the table; and a blocking structure disposed between the table and the clamp assembly, wherein the blocking structure has a top end disposed at a height above the table that is less than the height of the container, and wherein said blocking structure is detached from the first container;

(b.) placing the first container on the table;

(c.) controlling the electric motor to move the clamp assembly downward into contact with the first container and maintain a clamping pressure on the first container that does not exceed a predetermined maximum amount;

(d) vibrating the table, thereby mixing the fluid dispersion in the first container;

(e) controlling the electric motor to raise the clamp assembly;

(f) removing the first container from the table;

(g) placing the second container on the table;

(h.) controlling the electric motor to move the clamp assembly downward into contact with the blocking structure; and (i.) vibrating the table, thereby mixing the fluid dispersion in the second container.

5. A mixing apparatus comprising:

a table;

a frame connected to said table;

a clamp assembly comprising an upper bar, wherein said clamp assembly is disposed above the table so as to define a holding space between the table and the clamp assembly;

a first electric motor connected to the clamp assembly for moving the clamp assembly toward and away from the table so as to change the height of the holding space;

a second electric motor connected to the table for vibrating the table;

a control system electrically connected to the first electric motor and operable to control the first electric motor so as to move the clamp assembly downward;

a container; and at least one blocking structure comprising a top contact surface, wherein said blocking structure is disposed between the table and the clamp assembly to limit the downward movement of the clamp assembly and thereby establish a lowermost position of the clamp assembly, and wherein the lowermost position of the clamp assembly is defined by contact of the upper bar with the contact surface of the blocking structure, and wherein said blocking structure is detached from the container when the clamp assembly is in its lowermost position.

* * * * *